US006025307A

United States Patent [19]

Chittofrati et al.

[11] Patent Number: 6,025,307

[45] Date of Patent: Feb. 15, 2000

[54] FLUORINATED GREASES

[75] Inventors: Alba Chittofrati, Milan; Paolo Lazzari, Cagliari; Luca Caluso, Milan, all of Italy

[73] Assignee: Ausimont S.p.A., Milan, Italy

[21] Appl. No.: 09/044,180

[22] Filed: Mar. 19, 1998

[30] Foreign Application Priority Data

Mar. 21, 1997 [IT] Italy ..... MI97A0656

[51] Int. Cl.[7] ..... C10M 119/22

[52] U.S. Cl. ..... 508/182

[58] Field of Search ..... 508/182

[56] References Cited

U.S. PATENT DOCUMENTS

| | | | |
|---|---|---|---|
| 2,242,218 | 5/1941 | Auer . | |
| 3,505,229 | 4/1970 | Skehan | 508/182 |
| 3,665,041 | 5/1972 | Sianesi et al. . | |
| 3,715,378 | 2/1973 | Sianesi et al. . | |
| 3,723,317 | 3/1973 | Ulery | 508/182 |
| 4,324,673 | 4/1982 | Christian et al. | 508/182 |
| 4,431,555 | 2/1984 | Christian et al. | 508/182 |
| 4,431,556 | 2/1984 | Christian et al. | 508/182 |
| 4,472,290 | 9/1984 | Caporiccio et al. . | |
| 4,523,039 | 6/1985 | Lagow et al. . | |
| 4,675,380 | 6/1987 | Buckmaster et al. . | |
| 4,724,092 | 2/1988 | Fukui et al. | 508/182 |
| 4,789,717 | 12/1988 | Giannetti et al. . | |
| 4,864,006 | 9/1989 | Giannetti et al. . | |
| 4,906,770 | 3/1990 | Marchionni et al. . | |
| 5,000,864 | 3/1991 | Strepparola et al. . | |
| 5,051,158 | 9/1991 | Marchionni et al. . | |

FOREIGN PATENT DOCUMENTS

| | | |
|---|---|---|
| 0 247 379 A1 | 12/1937 | European Pat. Off. . |
| 1104482 | 2/1968 | European Pat. Off. . |
| 1226566 | 3/1971 | European Pat. Off. . |
| 0 075 312 A2 | 3/1983 | European Pat. Off. . |
| 0 148 482 A2 | 7/1985 | European Pat. Off. . |
| 605 403 A2 | 7/1994 | European Pat. Off. . |
| 0 633 274 A1 | 1/1995 | European Pat. Off. . |
| 0 687 533 A1 | 12/1995 | European Pat. Off. . |
| 0 695 775 A1 | 2/1996 | European Pat. Off. . |
| 0 709 517 A1 | 5/1996 | European Pat. Off. . |

OTHER PUBLICATIONS

J. Messina J. Am. Soc. of Lubr. Eng. (Dec., 1969) pp. 475–481.

*Primary Examiner*—Jerry D. Johnson
*Attorney, Agent, or Firm*—Nikaido Marmelstein Murray & Oram, LLP

[57] ABSTRACT

Fluorinated greases comprising (by weight):

15%–50% polytetrafluoroethylene or tetrafluoroethylene copolymers with other ethylenically unsaturated monomers;

30%–84.5% perfluoropolyether oil having a viscosity comprised between 20 and 4000 cSt at 20° C.;

0.5%–10% surfactant or dispersant having perfluoropolyether or perfluoroalkylic chain;

0%–10% of an anticorrosion and/or antiwear additive, such that the (per)fluoropolymer particles based on TFE or their aggregates have average sizes lower than the micron and show improved diameter WEAR values.

17 Claims, No Drawings

FLUORINATED GREASES

The present invention relates to greases or lubricating pastes based on perfluoropolyethers (PFPE) and fluorinated polymers, in particular tetrafluoroethylene polymers (polytetrafluoroethylene PTFE), or tetrafluoroethylene copolymers with other ethylenically unsaturated monomers totally or partially fluorinated.

It is known that a fluorinated grease can be prepared by suspending a polytetrafluoroethylene polymer in a perfluorinated liquid, such as perfluoropolyethers. See, for instance, J. Messina J. Am. Soc. of Lubr. Eng. (December 1969) 475–481 and U.S. Pat. No. 4,472,290. The PTFE polymer was usually in a 7% by weight suspension in 1,1,2-trichlorotrifluoroethane. The method of the grease formulation consisted in slowly adding the PFPE to the 7% PTFE suspension by contemporaneously evaporating the solvent under vacuum.

The process is very long and delicate and in particular the preparation of an amount of about 30 kg of grease requires the use of a volume up to about 50 l of polymer suspension. The process is no longer usable owing to the known legislative rules on the use of chlorofluorocarbons (CFC).

The processes for preparing greases are at present based on the dispersion in the lubricating oil PFPE of dry powder of the fluorinated polymer.

The drawbacks of such techniques reside in the fact that the dry powder is formed by coagula and therefore it is necessary a finishing treatment to reduce the coagula size and to homogenize the system in order to obtain the desired lubricating properties.

In particular it is known from the U.S. Pat. No. 4,472,290 a process to prepare lubricating greases based on PTFE and perfluoropolyethers consisting in heating the PTFE powder under vacuum, in heating under vacuum PEPE oil and additive, in slowly mixing the components under vacuum, in cooling at room temperature and finishing in 3 roll mill in order to reduce the coagula and homogenize the system.

The drawbacks of such process are the method complexity and a careful check of the operating conditions of the three roll mill, such as for instance the rotation rate and the distance among the rolls.

The grease obtained through the process described in said patent has generally the following composition: from 15% to 40% by weight of PTFE, from 60% to 85% by weight of a liquid PFPE, less than 1% of a perfluoroalkylic or polyoxyyperfluoroalkylic surfactant and optionally additives such as for instance stabilizer agents and corrosion inhibitors. It is known that such additives modify the greases properties. See for instance also U.S. Pat. No. 5,000,864.

There was a need to have available an improved grease based on TFE (co)polymers showing a combination of improved lubricating characteristics, in particular as wear resistance values, low values of oil separation and low volatility.

It has been unexpectedly and surprisingly found by the Applicant a grease which, with the same components of the fluorinated greases known in the art, shows lower diameter WEAR values, as measured according to the ASTM D2266: 1 h at 75° C.; 40 kg load; 1200 rpm, although they maintain excellent lubricating properties, in particular those indicated above, of the greases based on TFE and PFPE (co)polymers.

An object of the present invention is a fluorinatd grease comprising at least:

15%–50% by weight of a polytetrafluoroethylene or tetrafluoroethylene copolymers with other ethylenically unsaturated monomers totally or partially fluorinated;

30%–84.5% by weight of a perfluoropolyether oil having viscosity comprised between 20 and 4000 cSt at 20° C.;

0.5%–10% by weight of a surfactant or dispersant having a perfluoropolyether or perfluoroalkyl chain;

0%–10% by weight of an anticorrosion and/or antiwear additive, such that the (per)fluoropolymer particles based on TFE or their aggregates have average sizes lower than a micron and such that with the same composition shows WEAR diameter values lower than at least 25% with respect to those of the corresponding fluorinated grease of the prior art, the components of the formulation being equal.

Preferably the fluorinated grease object of the present invention is characterized in that it contains at least 15–30% by weight of polytetrafluoroethyene or its copolymers as indicated above.

As tetrafluoroethylene copolymers it can be mentioned, for instance:

A) modified polytetrafluoroethyene containaing small amounts, generally comprised between 0.01 and 3% by moles, preferably between 0.05% and 0.5% by moles, of one or more comonomers selected from perfluoroalkylperfluorovinylethers, such as for instance methylvinylether and propylvinylether; vinylidene fluoride; hexafluoroisobutene; chlorotrifluoroethylene; perfluoroalkylethylenes, such as for instance perfluoropropene;

B) tetrafluoroethylene (TFE) thermoplastic copolymers containing from 0.5 to 8% by moles of at least a perfluoroalkylvinylether, wherein the perfluoroalkylic radical has from 1 to 6 carbon atoms, such as for instance, TFE/perfluoropropylvinylether, TFE/perfluoromethylvinylether, TFE/perfluoroethylvinylether, TFE/perfluoroalkylethylene copolymers;

C) tetrafluoroethylene thermoplastic copolymers containing from 2 to 20% by moles of a perfluoroolefin $C_3$–$C_8$, such as for instance the TFE/hexafluoropropene copolymer, to which small amounts can be added (lower than 5% by moles) of other comonomers having a perfluorovinylether structure (as described, for instance, in U.S. Pat. No. 4,675,380);

D) tetrafluoroethyene thermoplastic copolymers containing from 0.5 to 13% by weight of perfluoromethylvinylether and from 0.05 to 5% by weight of one or more fluorinated monomers selected from the group formed by:

$$1)\ R_FO—CF=CF_2 \qquad (II)$$

wherein $R_F$ can be:

i) a perfluoroalkyl radical containing from 2 to 12 carbon atoms;

$$ii)\ —(CF_2—CF(CF_3)—O)_r—(CF_2)_{r'}—CF_3 \qquad (III)$$

wherein r is an integer comprised between 1 and 4 and r' is an integer comprised between 0 and 3;

$$iii)\ —Z(OCFX)_q(OCF_2—CFY)_{q'}—O—T \qquad (IV)$$

wherein the units (OCFX) and ($OCF_2$—CFY) are statistically distributed along the chain;

T is a (per)fluoroalkyl radical from 1 to 3 C atoms, optionally containing one H or Cl atom;

X and Y are equal to- —F or —$CF_3$;

Z represents —(CFX)— or —($CF_2$—CFY)—;

q and q', equal to or differnt from each other, are integers comprised between 0 and 10;

the average number molecular weight of the monomer is comprised between 200 and 2,000:

$$2)\ R_F—CH=CH_2 \qquad (VII)$$

wherein $R_F$ has the meaning described in 1);

3) a perfluorodioxole, preferably having formula:

(VIII)

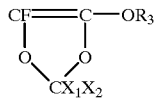

wherein $R_3$ is a perfluoroalkyl radical $C_1$–$C_5$, preferably CF3;

$X_1$ and $X_2$ are, independently from each other, a fluorine atom or a perfluoroalkyl with one to three carbon atoms, preferably a $CF_3$.

The preferred weight ratio by weight of the three classes of monomers forming the tetrafluoroethylene/perfluoromethylvinylethers/fluorinated monomers (D) thermoplastic copolymers is the following:

perfluoromethylvinylether: 2–9%, by weight;

fluorinated monomers 0.1–1.5%, by weight;

tetrafluoroethylene: complement to 100% by weight.

Among the comonomers of formula (II) it can be cited, for instance, perfluoroethylvinylether, perfluoropropylvinylether and perfluorobutylvinylether. The preferred comonomer of this class is perfluoropropylvinylether.

The comonomers of formula (III) are described, for instance, in European Patent Application 75,312. Examples of these comonomers ar those in which r can be 1 or 2 and r' is 2.

The comonomes of formula (IV) are obtained by dechlorination of the compounds of formula:

$$CF_2Cl—CFCl—O—Z(CFXO)_q—(OCF_2—CFY)_{q'}—O—T$$

which can be prepared as described in the Example 11 of U.S. Pat. No. 4, 906,770.

In the comonomers of formula (VII) $R_F$—CH=$CH_2$, the $R_F$ radical preferably contains from 2 to 6 carbon atoms. Examples of these comonomers are perfluorobutylethylene and perfluorohexylethylene.

The fluorinated comonomers from (1) to (3) described above can be copolymerized with TFE and perfluoromethylvinylether alone to give terpolymers or in combination each other to give tetrapolymers or copolymers having a more complex composition.

The tetrafluoroethylene copolymers can be prepared by radical polymerization in aqueous medium. It results particularly suitable to carry out the polymerization in aqueous phase using a dispersion or a microemulsion of perfluoropolyether according to European Patent Application 247, 379, or, preferably, according to U.S. Pat. No. 4,864,006.

The preferred TFE (co)polymers to be utilized for preparing the grease of the present invention are the TFE (PTFE) homopolymers or TFE copolymers with perfluoromethylvinylether between 0.05 and 8% by moles, the latter are known as MFA perfluoropolymers.

The Melt Flow Index (MFI) is a common indicator of the polymer average molecular weight. The MFI (ASTM D1238-52T) of PTFE or of its copolymers can generally range between 0.1 and 30. Also TFE (co)polymers with molecular weight up to 1,000,000 are however suitable.

As perfluoropolyether oils are meant compounds comprising fluorooxyalkylenic units selected from the following:

($CF_2CF_2O$), ($CF_2O$), ($CF_2CF(CF_3)O$), ($CF(CF_3)O$), ($CF_2CF_2CF_2O$), (CF2CF($OX_3$)O) and ($CF(OX_3)O$), wherein $X_3$ is —$(CF_2)_nCF_3$ and n=0,1,2,3,4, said units being statistically distributed in the polymeric chain. The end groups are of fluoroalkylic type optionally containing one chlorine and/or H atom, for instance: —$CF_3$, —$C_2F_5$, —$C_3F_7$, $ClCF_2CF(CF_3)$—, $CF_3CFClCF_2$—, $ClCF_2CF_2$—, $ClCF_2$—, —$CF_2H$, —$CF(CF_3)H$. Perfluoropolyethers of "neutral" type can for instance be used, i.e., having perfluoroalkylic end groups with viscosity at 20° C. generally comprised between 20 and 4000 cSt and average molecular weights between 700 and 20,000 selected from the following classes:

$$(a_1)\ T_1—O(CF(CF_3)—CF_2O)_a(CFXO)_b—T_2$$

wherein:

$T_1$ and $T_2$, equal to or different from each other, can be —$CF_3$, —$C_2F_5$, —$C_3F_7$ groups, X is —F or —$CF_3$;

a, b are integers such that the molecular weight is comprised within the range indicated above.

These perfluoropolyethers are obtained according to the process described in UK 1,104,482 and with successive conversion of the end groups into unreactive groups according to the process described in the UK 1,226,566.

$$(b_1)\ CF_3—O(CF_2CF_2O)_c(CF_2O)_d—CF_3$$

wherein:

c, d are integers such that the molecular weight is comprised in the range indicated above.

These PFPE are prepared by $C_2F_4$ photochemical oxidation according to U.S. Pat. No. 3,715,378.

$$(c_1)\ C_3F_7—O(CF(CF_3)—CF_2O)_e—T_3$$

wherein:

$T_3$ can be —$C_2F_5$, —$C_3F_7$;

e is an integer such that the molecular weight is comprised in the range indicated above.

These compounds are prepared by ionic oligomerization of hexafluoropropene epoxide and successive treatment of the acylfluoride (COF) with fluorine according to U.S. Pat. No. 2,242,218.

$$(d_1)\ T_4—O(CF(CF_3)—CF_2O)_g(C_2F_4O)_h(CFXO)_i—T_5\ CF_3$$

wherein:

$T_4$ and $T_5$, equal to or different from each other, are perfluorinated groups —$CF_3$, —$C_2F_5$, —$C_3F_7$;

X is —F or —$CF_3$;

g, h, i, are integers such that the molecular weight is comprised in the range indicated above.

These products are obtained by photooxidation of $C_3F_6$ and $C_2F_4$ mixtures and successive treatment with fluorine according to the process described in the U.S. Pat. No. 3,665,041.

$$(e_1)\ T_6—O(CF_2CF_2CF_2O)_l—T_7$$

wherein:

$T_6$ and $T_7$, equal to or different from each other are $—CF_3$, $—C_2F_5$, $—C_3F_7$ groups;

l is an integer such that the molecular weight is comprised in the range indicated above.

These products are obtained acording to the EP 148,482.

$$(f_1)\ T_8—O(CF_2CF_2O)_m—T_9$$

wherein:

$T_8$ and $T_9$, equal to or different from each other, are $—CF_3$, $—C_2F_5$ groups; m is an integer such that the molecular weight is comprised in the range indicated above.

These products are obtained according to U.S. Pat. No. 4,523,039.

The (per)fluoropolyethers with chlorinated end groups can be obtained for instance as described in U.S. Pat. No. 5,051,158.

The (per)fluoropolyethers with hydrogenated end groups are prepared acording to EP 695,775.

The preferred (per)fluoropolyethers are those of the classes ($a_1$), ($b_1$) and ($d_1$) having viscosity from 1,000 to 3,000 cSt, preferably from 1,200 to 2,000 cSt.

The fluorinated surfactant having a perfluoropolyether or perfluoroalkyl chain can be both of ionic and non ionic type. It is also possible to use surfactant mixtures. In particular, as regards the functional part suitably linked to the fluorinated chain it can be cited:

A') mono and dicarboxylic acids and their salts;

B') sulphonic acids and their salts;

C') phosphoric esters and their salts having 1 or 2 hydrophobic chains; see for instance the European patents EP-687,533 and EP-709,517.;

D') non ionic surfactants having fluorinated chains and polyoxyalkylenic chains; see for instance the European Patent Applications EP 97,111,448.3, EP 97,111,447.5 and EP 97,114,418.3 herein incorporated by reference;

E') cation surfactants having 1, 2 or 3 hydrophobic chains.

Carboxylic surfactants having a perfluoropolyether chain with average molecular weight lower than 600 are preferably used, the perfluoropolyether chain being preferably of the ($a_1$) type.

As anticorrosion and/or antiwear agents are meant those known in the art such as for instance those mentioned in U.S. Pat. No. 4,472,290, U.S. Pat. No. 5,000,864 and in EP 687,533 and EP 709,517.

Preferably the fluorinatd grease of the present invention which shows a combination of improved properties is obtainable with the processes described hereinafter.

In particular it has been found by the Applicant that the process to produce the fluorinated greases of the invention reduces the drawbacks mentioned in the preparation of the greases of the prior art, in particular it does not utilize the finishing treatment in a three roll mill. This represents a further advantage from the industrial point of view as it remarkably semplifies the technology of the fluorinated greases production.

A further object of the present invention is therefore a process to produce fluorinated greases as defined above characterized in that it comprises at least the following steps:

a') one starts from the dispersions as obtained by the polymerization process in aqueous phase;

b') additivation to a TFE-based (per)fluoropolymer in aqueous matrix of surfactants in an amount from 50 to 500 mg per gram of polymer, preferably from 100 to 300 mg;

c') addition to the aqueous matrix of point b') of a perfluoropolyether oil with viscosity lower than 5 cSt at 25° C. and a boiling point not higher than 150° C., or of a fluorocarbon with a boiling point lower than 150° C., so that the ratio by weight polymer/oil is lower than 0.5, preferably comprised between 0.3 and 0.1;

d') addition of a perfluoropolyether oil having viscosity comprised between 20 and 4000 cSt at 20° C. in amount such as to obtain in the final grease a percentage by weight of the polymer comprised between 15% and 50%, preferably between 22% and 30%;

e') complete evaporation of the low boiling components under vacuum at a temperature comprised between 50° C. and 90° C.

Antirust and antiwear additives are known in the art to further improve these properties, for instance those mentioned in U.S. Pat. No. 4,472,290 and U.S. Pat. No. 5,000,864 can be used. These additives can be added in any phase of the process object of the invention. In particular it has been found that the additivation carried out in any phase b')–d') allows to have a more homogeneus distribution in the final grase.

The low boiling components, i.e. water, low boiling perfluoropolyether or other (per)fluorocarbons and optionally surfactants, can be recovered by condensation.

The surfactants or dispersants utilized in point b') can have as such antiwear and/or antirust properties. In this case it is not necessary to introduce other aditives.

AS (per)fluoropolymers in aqueous matrix are meant latexes obtained by the polymerization processes utilizing water as reaction medium, preferably latexes obtained by emulsion processes, more preferably by microemulsion processes: see for instance U.S. Pat. No. 4,864,006 and U.S. Pat. No. 4,789,717.

It has been verified, and this is a further object of the invention, that if dispersions of fluoropolymers obtained by suspension processes, i.e. employing fluorinated solvents or however mixible with perfluoropolyethers are utilized, the process indicated above can be simplified and the steps from a') to c') are omitted.

The surfactants of point b') can be added pure or in hydroalcoholic solution and/or suspension.

As perfluoropolyether oils of points c') and d') are meant the compounds having a structure as defined above, with viscosity comprised within the values indicated in said process steps.

Instead of the perfluoropolyether of point c'), also the corresponding structures can be utilized wherein one or both the end groups contain an hydrogen atom. For these structures see the European Patent Application EP 97,103,590.2 in the name of the Applicant, wherein structures of various compounds with hydrogenated end groups are described. Instead of the perfluoropolyethers of point c') also perfluorocarbons can be used, optionally containing heteroatoms such as O and N, having volatility values similar to those of the perfluoropolyethers of point c').

After the addition of the perfluoropolyether oil at point c') depending on the surfactant utilized, either a dispersion in mixed phase water/oil or a polymer dispersion in oil with surnatant water which can be optionally separated, can be obtained. The skilled knows how to select the surfactants according to the prior art to minimize the emulsification of the water in oil and viceversa, and to make easier its recovery. This however does not influence the process of the present invention.

By light scattering, on the samples suitably diluted with the same oil of point c'), it has been ascertained that the transfer in oil phase or however the obtaining of systems in mixed phase water/oil, does not involve substantial variation of the sizes of the polymer aggregates with respect to the aqueous dispersion of point b').

The fact to obtain at point c') an emulsion or a separation water oil does not influence however the properties of the grease obtained. The process can however be carried on also in the case of complete emulsification of the system.

Preferably the aqueous matrix of (per)fluoropolymer at point b') is obtained by a gelling process, neutralization, gel dispersion, of the aqueous latexes of point a').

The process is characterized in that it comprises at least the following steps:

a") gel formation by addition of electrolytes. In the case of inorganic univalent electrolytes the necessary concentration to have complete gelling is higher than $10^{-3}$ by mole in the gel. Preferably inorganic uni-univalent electrolytes, such as for instance nitric acid or preferably sodium-nitrate, are used. With nitric acid gelling takes place preferably at a pH comprised between 0.5 and 2.

The gel formation can be carried out by depositing the electrolyte solution on the latex surface in static conditions or however in mild stirring conditions to avoid coagulation phenomena.

b") gel neutralization with diluted alkaline solutions (e.g. NaOH $10^{-4}$ M), final pH 6–7, and successive washing with water;

c") gel redispersion with the described surfactants; preferably Na or K carboxylic salts, phosphoric esters, more preferably sodium and potassium carboxylic salts, having an average molecular weight not higher than 600.

The surfactants can be added to the gel both as such, if liquid, and in aqueous or hydroalcoholic solution and/or dispersion with a concentration comprised between 10 and 90% by weight.

The amount necessary to the gel redispersion is comprised between 50 and 500 mg per gram of polymer.

The use of carboxylic surfactants having a perfluoropolyether chain with an average molecular weight not higher than 600 allows to limit the content thereof in the final grease (<3.5% by weight), being capable of dividing itself prevalently in water during the preparation c') step and to make nearly complete the separation of the aqueous phase from the fluorinated oil having low viscosity in point c').

The skilled is capable of selecting according to the prior art the most suitable surfactants depending on the cases.

The dispersion obtained from gel forms the (per) fluoropolymer in aqueous matrix described at point b') for the greases formation process previously described.

When in the process the gelling stage is utilized, it has been found that higher yields are obtained in the transfer of the TFE-based polymer from the aqueous phase to the organic fluorinated phase (point c')).

Indeed in the general process at point c') there is the partial or total transfer of the polymer particles from the aqueous phase to the fluorinated phase.

The following examples are given for illustrative purposes but are not limitative of the present invention.

EXAMPLES a. Aqueous Dispersions by Gel Redispersion

Example 1

The utilized latex contained a terpolymer formed by TFE-FMVE-FPVE in molar ratio 96.15:3.5:0.35 and prepared according to the process described in Example 1 of EP 633,274. The polymer particles sizes were 75 nm of average diameter. The obtained latex had a concentration of 30.8% by weight of polymer.

220 g of latex were put in a glass column (length 22 cm; diameter 4 cm) with a porous separator on the bottom (class G2; pore diameter 40–100 micron), previously wetted with a 0.32 M solution of $HNO_3$, and then acidified by introducing from the top 6.8 ml of nitric acid 6.8 M, with formation of about 200 ml of a gel phase at pH 1. The column bottom was then connected with a tank containing a NaOH $10^{-3}$ M solution. The NaOH solution was forced through the column by a recharging metering pump (50 ml volume) working at 60 ml/hour. The column head was connected to a tank for the recovery of the solutions forced from the bottom by the pump.

The gel phase was neutralized with the NaOH $10^{-3}$ M solution (27 doses by 50 ml each) to have a final pH equal to 6, and then washed with 250 ml of bidistilled water up to a content of $NO_3^-$ ions of 5 ppm, determined by ionic chromatography. The polymer content in the gel phase was 30% by weight.

The gel phase was additivated with 81.2 g of a 25% by weight aqueous solution of the non ionic S1 dispersing surfactant:

$$R_{F3}—CO—NH—CH(CH_3)CH_2(OCH(CH_3)CH_2)_s —(OCH_2CH_2)_{40,5}—(OCH_2CH(CH_3))_t—NH—CO—R_{F3}$$

wherein:

s+t=2.5 and $R_{F3}$ is $R_{F2}O(CF(CF_3)—CF_2O)_{n'}(CF(CF_3)O)_{p'}(CF_2O)_{m'}CF_2$ $R_{F3}$ has an average molecular weight=650 and $R_{F2}$ is perfluoroalkyl from 1 to 3 carbon atoms;

so as to obtain a dispersion of aggregates of polymer particles in aqueous phase with average diameter lower than 400 nm, with wide dimensional distribution which comprises also the polymer primary particles of 75 nm. The obtained dispersion composition is such as to have 300 mg of surfactant S1 per gram of polymer.

Example 1 was repeated by replacing in the gelling step the $HNO_3$ solutions with solutions with similar concentration of $NaNO_3$, reducing the number of the doses of NaOH $10^{-3}$ M and obtaining a gel with a pH 6.7.

Example 2

Example 1 was repeated by utilizing the same latex, by substituting the aqueous solution of non ionic surfactant S1 with 27.2 g of a 25% by weight aqueous solution of the sodic salt of a carboxylate having a perfluoropolyether chain $R_{F3}$ of the type defined above, with end group $R_{F4}$=$ClC_3F_6$ in replacement of the end group $R_{F2}$. Such surfactant, having an average molecular weight of 426, is defined as S2.

The composition of the obtained dispersion is such as to have 100 mg of surfactant S2 per gram of polymer.

Example 3

Example 1 was repeated by utilizing the same latex, by substituting the aqueous solution of non ionic surfactant S1 with 34 g of a 20% by weight aqueous solution of the ammonium salt of a carboxylate having a structure and end group similar to S2, but having an average molecular weight of 530.

The surfactant employed in Example 3 is defined as S3.

The composition of the obtained dispersion is such as to have 100 mg of surfactant S3 per gram of polymer.

Example 4

A PTFE latex prepared according to the polymerization process in microemulsion according to U.S. Pat. No. 4,864,006 was used.

The polymer content in the latex was of 14.4% by weight and the particles had an average diameter of 70 nm.

216 g of latex were treated as in Examples 1–3. The final gel phase, at pH 7, had a polymer content of 17.6% by weight.

The gel phase was additived with 37.2 g of a 25% aqueous solution of the non ionic surfactant S1 defined above, so as to have 300 mg of surfactant per gram of polymer, obtaining a dispersion in aqueous phase of polymer particles aggregates with average diameter lower than 400 nm, with wide dimensional distribution which comprises also the 70 nm primary particles.

Example 5

A PTFE latex prepared by polymerization in aqueous dispersion according to U.S. Pat. No. 4,789,617 was utilized without using the perfluoropolyether.

The latex was formed by particles of the same diameter of about 0.2 micron and had a concentration of dry powder of 27.2% by weight.

300 g of latex were treated as in Examples 1–3. The final gel phase, at pH 7.5, had a polymer content of 37.5% by weight.

The gel phase was additived with 97.9 g of a 25% aqueous solution of the non ionic surfactant S1 defined above, obtaining a dispersion in aqueous phase of particles aggregates with average diameter lower than the micron, with wide dimensional distribution which comprises also the polymer primary particles.

b. Dispersions in Fluorinated Oils having Low Viscosity and Boiling Point

Example 6

307.1g of an aqueous disperion obtained according to Example 1 were additived with 271 g of Galden® HT 70 (Ausimont) belonging to class $a_1$), with b.p. of 70° C. and viscosity of 0.5 cSt at 25° C. The polymer/oil ratio was of 0.25 weight/weight.

By hand stirring, the polymer particles were transferred from the aqueous phase to the fluorinated oil. The surnatant aqueous phase was taken after about 4 hours of decantation.

The obtained polymer dispersion in oil contained 19.4% by weight of polymer (corresponding to 99.8% of the initial polymer), 0.8% by weight of the non ionic surfactant S1 defined above (corresponding to 13% of S1 starting amount), an amount of residual water (Karl Fischer titration) equal to 2% by weight and 77.8% by weight of Galden® oil HT 70.

The final dispersion was formed by particulate having an average diameter lower than 500 nm, with wide dimensional distribution comprising also the 75 nm polymer primary particles.

The separated aqueous phase was dried at 80° C. recovering about 87% of the starting amount of the non ionic surfactant S1.

Example 7

In a 1 l glass separatory funnel, 279.2 g of the same aqueous latex of Examples 1–3 containing 30.8% by weight of polymer and 103.2 g of an aqueous solution with 25% by weight of the non ionic surfacant S1 previously defined, were introduced.

After homogenizing, the aqueous dispersion was additived with 344 g of the same Galden oil of the Example 6 and handly stirred. The (weight/weight) polymer/oil ratio was 0.25.

The water/oil/polymer dispersion was decanted for 20 hours, thus separating: a heavier phase, prevailingly formed by Galden® oil HT 70 and containing 20% of the amount of polymer initially in the aqueous latex; a surnatant aqueous phase with polymer concentration of 29% by weight, very close to the initial one in the latex.

The efficency of the polymer transfer from water to fluorinated oil results acceptable, but it is very lower than that obtained by gelling of the same latex used in Example 6. The separated oil phase, at 5% by weight of polymer, contained 0.9% of the non ionic surfactant S1, corresponding to 13.9% of the amount of the surfactant in the initial latex.

Example 8

An aqueous dispersion obtained according to Example 2 was additived with 271 g of Galden® oil HT 70.

By operating as in the Example 6, dispersions of polymer in oil containing 19.5% by weight of polymer (corresponding to 99.4% of the initial polymer), 0.6% by weight of the carboxylic surfactant S2 previously defined (corresponding to 30% of the initial S2 amount), an amount of residual water (Karl Fischer titration) equal to 1.2% by weight and 78.7% by weight of fluorinated oil, were obtained.

The separated surnatant aqueous phase was dried at 80° C., recovering about 70% of the amount of surfactant S2 initially added.

Example 9

An aqueous dispersion obtained according to Example 3 was additived with 271 g of Galden® oil HT 70.

By operating as in the case of Example 6, dispersions of polymer in oil containing 19.5% by weight of polymer (corresponding to 99.4% of the initial polymer), 0.6% by weight of the carboxylic surfactant S3 previously defined (corresponding to 30% of the initial S3 amount), an amount of residual water (Karl Fischer titration) equal to 1.2% by weight and 78.7% by weight off fluorinated oil, were obtained.

The separated surnatant aqueous phase was dried at 80° C., recovering about 70% of the amount of surfactant S3 initially added.

Example 10

An aqueous dispersion obtained according to Example 4 was additivated with 155.5 g of Galden® HT 70, corresponding to a polymer/oil ratio of 0.2 (weight/weight).

By operating as in the case of Example 6, a dispersion of polymer in oil containing 16.2% by weight of polymer (corresponding to 99.8% of the initial polymer), 0.7% by weight of non ionic surfactant S1 (corresponding to 14% of the initial S1 amount), an amount of residual water (Karl Fischer titration) equal to 1.8% by weight and 81.3% by weight of fluorinated oil, was obtained.

The separated surnatant aqueous phase was dried at 80° C., recovering about 86% of the amount of the initially added surfactant.

Example 11

315.5 g of an aqueous dispersion obtained according to Example 5, containing the non ionic surfactant S1 defined above, was additived with 408 g of Galden® oil HT 70, corresponding to a polymer/oil ratio of 0.2 (weight/weight).

By operating as in the case of the Example 6, but by taking the aqueous phase after about 12 hours of decantation, a dispersion of polymer in oil containing 13.4% by weight of polymer (corresponding to 80% of the initial polymer), 1% by weight of the surfactant S1 (corresponding to 20% of the initial S1 amount), 83.6% by weight of fluorinated oil and an amount of residual water (Karl Fischer titration) equal to 2% by weight, was obtained.

c. Greases Preparation

Example 12

A polymer dispersion in Galden® oil HT 70, prepared according to Example 6 starting from the materials of the Example 1 and containing 67.62 g of polymer and 2.64 g of non ionic surfactant S1, was additived with 141.05 g of Fomblin® oil YR (Ausimont), belonging to class $a_1$) and characterized by a viscosity of 1500 cSt at 20° C., so as to have 32% by weight of polymer based on the sum of the weights of the polymer, the Fomblin® oil YR oil and the surfactant.

The obtained dispersion was poured into a 2 l flask. BY connecting the flask to a rotavapor Heidolph-2001 working at 130–160 rpm, at residual pressure of 10 mmHg and with a thermostatic bath at 55° C., the dispersion fraction formed by the low boiling Galden® oil HT 70 and the water residue in the dispersion were removed from the sample and recondensed. The recovery of the Galden® oil HT 70, as well as the water removal (ceck by Karl Fischer titration), resulted complete.

The homogeneous phase remained in the flask, formed by 32% by weight of polymer, 1.3% by weight of non ionic surfactant S1 and by 66.7% of Fomblin® oil YR, was cooled at room temperature and then sampled for lubricating evaluation.

The results are reported in Table 1, where all the reported values refer to tests carried out in the standard conditions indicated hereinafter:

wear diameter: ASTM D2266 (1 hour at 75° C. or 250° C.; load 40 Kg; 1200 rpm);

oil separation: FTMS 791-321 (204° C. for 30 hours);

volatility: ASTM D2595 (204° C. for 22 hours).

Example 12 was repeated by replacing Fomblin® oil YR with an oil having the same viscosity, but the structure $b_1$).

Example 13

Example 12 was repeated, but the same dispersion of polymer and non ionic surfactant S1 in Galden® oil HT 70 was additived with an higher amount (171.2 g) of the same Fomblin® oil YR, so as to have 28% by weight of polymer with respect to the sum of the polymer, Fomblin® oil YR and surfactant S1 weights.

The obtained dispersion was treated according to Example 12 by completely recovering the Galden® oil HT 70, eliminating the residual water and obtaining an homogeneous phase formed by 28% of polymer, 1.1% by weight of non ionic surfactant S1 and 70.9% by weight of Fomblin® oil YR.

The results of the grease characterization are reported in Table 1.

A part of the sample was also subjected to EP test according to IP239 standard by obtaining 117 kg as mean Hertz load value and 200 Kg as starting welding load value.

Example 14

Example 13 was repeated, under the same conditions and with the same materials, by increasing the evaporation temperature of the low boiling components to 90° C.

An homogeneous dispersion formed by 28% by weight of polymer, 1.1% by weight of non ionic surfactant S1 and 70.9% by weight of Fomblin® oil YR, was obtained.

The elimination of the low boiling components resulted complete and quicker with respect to Example 13.

The data relating to the characterization of the obtained grease are reported in Table 1 and show the substantial unchanging of the Wear diameter with respect to the Example 13.

Example 15

A dispersion of polymer in Galden® oil HT 70 prepared according to Example 8 by starting from the materials of Example 2, containing 67.35 g of polymer and 2.04 g of carboxylic surfactant S2, was additived with 159.1 g of the same Fomblin® oil YR having high viscosity as in Examples 12–14.

The obtained dispersion was poured in a 2 l flask and additived with 12 g of the Fomblin ® DA305 additive having the properties described in U.S. Pat. No. 5,000,864 of the Applicant.

By operating exactly as in Example 12, the low boiling components were completely removed by obtaining a grease consisting of 28% by weight of polymer, 0.9% by weight of carboxylic surfactant S2, 5% by weight of Fomblin® DA305 additive and 66.1% by weight of Fomblin® oil YR.

After cooling at room temperature the sample was submitted to lubricating tests, the results of which are reported in Table 1.

A part of the sample was also subjected to Emchor test acording to DIN 51802 standard obtaining classification 0, which corresponds to total absence of corrosion.

Example 16

Example 15 was repeated, by operating with the same materials and under the same conditions, but by replacing the Fomblin® DA305 additive with the same amount (12 g) of an additive having a perfluoropolyether chain of phosphoric ester type having the properties described in EP 687,533 and having the general structure:

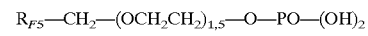

$$R_{F5}—CH_2—(OCH_2CH_2)_{1,5}—O—PO—(OH)_2 \quad (A1)$$

wherein:

$R_{F5}$ is $R_{F2}O(CF(CF_3)—CF_2O)_{n'}(CF(CF_3)O)_{p'}(CF_2O)_{m'}$ $CF_2$ $R_{F5}$ has an average molecular weight of 2900 and $R_{F2}$ is perfluoroalkyl from 1 to 3 carbon atoms.

By operating as in Example 15, the recovery of the low boiling components resulted complete and a grease was obtained formed by 28% by weight of polymer, 0.9% by weight of carboxylic surfactant S2, 5% of the additive (A1) and 66.1% of Fomblin® oil YR. After cooling at room temperature, the sample was subjected to lubricting tests, the results of which are reported in Table 1.

A part of the sample was also subjected to Emchor test acording to DIN 51802 standard, obtaining the classification 0, which corresponds to total absence of corrosion.

Example 17

Example 15 was repeated by operating with the same materials and under the same conditions but by replacing the Fomblin® DA305 additive with 9.54 g of a 25.2% by weight benzotriazole solution in 1:1.4 (weight/weight) mixture of isopropanol and of a low boiling perfluoropolyether oil of the class $a_1$) with a content of hydrogenated end groups corresponding to 9050 ppm of H and with average molecular weight of 220.

By operating as in Example 15, the recovery of the low boiling, isopropanol included, resulted complete and a grease was obtained consisting of 27.8% by weight of polymer, 0.8% by weight of carboxylic surfactant S2, 1% of benzo-triazole and 70.4% of Fomblin® oil YR. After cooling at room temperature, the sample was subjected to lubricating tests, the results of which are reported in Table 1.

Benzotriazole is an anticorrosion agent of hydrocarbon type, known in the art, unsoluble in Fomblin® oil YR and chemically incompatible with water. In the grease object of the invention, the spreading of benzotriazole, as indicated above, is easily obtained at the c') stage of the preparation, after separation of the aqueous surnatant layer, improving the dispersion uniformity thereof with respect to similar greases of the prior art.

Example 18

The polymer dispersion in Galden® oil HT 70 prepared according to Example 9 by starting from the materials of Example 3 and containing 67.35 g of polymer and 2.04 g of ammonic salt of the surfactant S3 defined above, was additivated with 171.1 g of Fomblin® oil YR. As a matter of fact the Example 13 was repeated with a different surfactant.

By operating as in the Example 12, the low boiling components were completely removed from the sample.

The obtained grease was formed by 28% by weight of polymer, 0.9% by weight of carboxylic surfactant S3 and 71.1% by weight of Fomblin® oil YR. After cooling at room temperature, the sample was subjected to lubricating tests, the results of which are reported in Table 1.

Example 19 (Comparative)

8.11 Kg of the same latex used in the Example 1 were coagulated by Shear, the obtained powder was washed with bidistilled water up to pH 6 and then dried in a stove at 220° C. for 20 hours.

2 kg of the dry powder were treated according to the Example 1 of U.S. Pat. No. 4,472,290 by using the same Fomblin® oil YR of Example 12, in such amount as to obtain 32% by weight of polymer in the comparative grease. Unless the surfactant the composition obtained herein is the same as the grease, object of the invention, of Example 12.

As shown by the result of the Wear test in Table 1, this grease prepared according to the prior art determines Wear diameter clearly higher that of the grease prepared in Example 12. From the data of Table 1, it is shown therefore that the grease according to the invention determines an improvement of 48% of the lubricating power.

Example 20 (Comparative)

2 Kg of the same dried powder of Example 19 were treated according to Example 1 of U.S. Pat. No. 4,472,290 by using the same Fomblin® oil YR of Example 13 and the non ionic surfactant S1, in such amounts as to obtain the grease of composition (% by weight): 28 polymer, 1.1 surfactant and 70.9 Fomblin® oil YR. The composition obtained herein according to the prior art is identical to that prepared, according to the invention, in the Example 13.

As shown by the results of the Wear test in Table 1, this comparative grease determines Wear diameter clearly higher than that of the grease prepared in Example 13. From the data of Table 1, it is shown therefore that the grease according to the invention determines an improvement of 113% of the lubricating power.

Example 21 (Comparative)

2 Kg of the same dried powder of Example 19 were treated according to the Example 1 of U.S. Pat. No. 4,472,290 by using the same Fomblin® oil YR, the same carboxylic surfactant S2 and the same additive Fomblin® DA305 of Example 15, in such amounts as to obtain the following composition (% by weight): 28 polymer, 0.9 surfactant S2, 5 Fomblin® DA305 additive and 66.1 Fomblin® oil YR.

The sample obtained herein according to the prior art, having the same composition of that prepared according to the invention of Example 15, has a viscosity much lower than that of the preparation of Example 15 and generally than those of the greases object of the invention. Such sample also results clearly less stable, with respect to the oil separation, than that of the corresponding preparation according to the invention (Example 15), as shown by the result of the oil separation test acording to FTMS 791-321 (204° C. for 30 hours) which shows the 30% by weight of oil separated from the sample prepared according to the art, with respect to the value of 11.2% relating to the grease of Example 15.

The Wear test therefore is not carried out since the sample does not appear stable owing to the high oil separation.

Example 22

185.2 g of a dispersion of polymer in Galden® oil HT 70 prepared according to Example 10 by starting from the materials of Example 4, and containing 30 g of homopolymer and 1.29 g of non ionic surfactant S1, were additived with 75 g of Fomblin® oil YR.

By operating as in Example 12, the low boiling components were completely eliminated.

The obtained homogeneous phase, formed by 24% by weight of polymer, 1% by weight of non ionic surfactnt S1 and 75% by weight of Fomblin® oil YR, was cooled at room temperature and evaluated in lubrication. The results are reported in Table 1.

Example 23 (Comparative)

6.94 Kg of the same latex of homopolymer used in Example 4 and forming also the starting material for the grease of Example 22, were coagulated by Shear. The obtained powder was washed with bidistilled water up to a pH 6.8, and then dried in a stove at 220° C. for 20 hours.

500 g of the dry powder were treated according to Example 1 of U.S. Pat. No. 4,472,290 by using 1.56 kg of the same Fomblin® oil YR of Example 22 and 20.8 g of non ionic surfactant S1, obtaining a grease having the same final composition of Example 22.

The grease obtained according to the prior art was evaluaed in lubrication, and the results are reported in Table 1.

With respect to the grease of the invention of Example 22, the sample having the same composition, prepared according to the prior art, shows a reduction of lubricating power, in terms of higher Wear diameter, of about 30%.

Example 24

450 g of a dispersion of homopolymer in Galden® oil HT 70, prepared according to Example 11 starting from the materials of Example 5, and containing 13.4% by weight of homopolymer and 1% by weight of non ionic S1 surfactnt, were additived with 68.2 g of Fomblin® oil YR. This example uses homopolymer having sizes of the primary particules clearly higher in comparison with those of Example 22.

Following the preparation procedure of Example 12, after the complete removal of the low boiling components, a grease was obtained consisting of 45.3% by weight of homopolymer, 3.4% by weight of non ionic surfactant S1 and 51.3% by weight of Fomblin® oil YR.

The results of the lubrication tests of the final grease are reported in Table 1.

Example 25 (Comparative)

3.68 kg of the same homopolymer latex having primary particles of equivalent diameter 0.2 micron used in Example 5 and forming the same starting material for preparing the grease of Example 24, were coagulated and the obtained powder was treated and dried as that of Example 23.

500 g of the dry powder were treated according to the Example 1 of U.S. Pat. No. 4,472,290 by using 566.2 g of Fomblin® oil YR and 37.5 g of non ionic surfactant S1, obtaining a grease having the same composition of Example 24.

As it results from the data in Table 1, the lubricating power in Wear diameter terms of the grease obtained according to prior art, results 100% lower than that of the grease prepared in Example 24.

Example 26

280 g of a dispersion of polymer in Galden® oil HT 70, prepared according to Example 7 starting from the same latex of Example 1, and containing 14 g of polymer and 2.52 g of non ionic surfactant S1, were additived with 33.5 g of Fomblin® oil YR.

The obtained dispersion was poured in a 1 l flask, treated according to what indicated in Example 12, until complete removal of the low boiling components.

The obtained grease, formed by 28% by weight of polymer, 5% by weight of non ionic surfactant S1 and 67% of Fomblin® oil YR, was evaluated in lubrication, and the results are reported in Table 1.

Example 27 (Comparative)

This example illustrates the need of utilizing a surfactant as dispersant in stage b') of the preparation according to the invention, even if the transfer of the polymer from the aqueous phase to fluorinated oil is however possible also without surfactant.

In a 20 l glass vessel, 3.37 kg of the same latex of Example 1 containing 30.8% by weight of polymer and 10.32 kg of Galden® oil HT 70 were introduced, to have a ratio by weight polymer/ oil of 0.1.

After mild stirring, a dispersion was obtained which was decanted for 20 hours 3 phases were thus separated: the heaviest, prevailingly formed by Galden® oil HT 70, containing 15.3% of the polymer initially in the latex; a central emulsion and a surnatant aqueous phase containg 27.2% by weight of polymer based on the total weight of the two phases. The polymer concentration in the separated Galden® oil HT 70 phase was 1.6% by weight.

12.5 kg of such dispersion were additived with 14.9 g of the non ionic surfactant S1 and with 478.6 g of Fomblin® oil YR oil.

Suitable amounts of the dispersion thus obtained were treated as in Example 12 and also in this case the removal of the low boiling components resulted complete.

The obtained grease was formed by 28% by weight of polymer, 5% by weight of surfactant S1 and 67% by weight of Fomblin® oil YR.

The results reported in Table 1, relating to the Wear test, show a decrease of the lubricating power of about 120% with respect to the grease of Example 26, with the same composition, but obtained according to the process object of the invention, where the utilization of the surfactant is foreseen at the b') stage.

TABLE 1

| Examples | Dispersing surfactant S | Additive | Polymer conc. (% wt) | Fomblin ® YR conc. (% by wt) | Conc. S (% by weight) | Additive conc. (% wt) | WEAR (mm) | Oil separat. (% wt) | Oil Volatility (% wt) |
|---|---|---|---|---|---|---|---|---|---|
| 12 | S1 | none | 32 | 66.7 | 1.3 | 0 | 1.08 | 6.2 | 6 |
| 13 | S1 | none | 28 | 70.9 | 1.1 | 0 | 0.8 | 8.5 | 2.8 |
| 14 | S1 | none | 28 | 70.9 | 1.1 | 0 | 1 | 12 | 2.3 |
| 15 | S2 | Fomblin ® DA305 | 28 | 66.1 | 0.9 | 5 | 0.64 | 11.2 | 2.7 |
| 16 | S2 | A1 | 28 | 66.1 | 0.9 | 5 | 0.72 | 18 | 2.1 |
| 17 | S2 | benzo-triazole | 27.8 | 70.4 | 0.8 | 1 | 1.1 | — | — |
| 18 | S3 | none | 28 | 71.1 | 0.9 | 0 | 0.93 | 8.1 | 4.1 |
| 19 (comp) | none | none | 32 | 68 | 0 | 0 | 1.6 | 7.7 | — |
| 20 (comp) | S1 | none | 28 | 70.9 | 1.1 | 0 | 1.7 | 7.2 | 0.6 |
| 22 | S1 | none | 24 | 75 | 1 | 0 | 1.08 | 10.9 | 1.5 |

TABLE 1-continued

| Examples | Dispersing surfactant S | Additive | Polymer conc. (% wt) | Fomblin ® YR conc. (% by wt) | Conc. S (% by weight) | Additive conc. (% wt) | WEAR (mm) | Oil separat. (% wt) | Oil Volatility (% wt) |
|---|---|---|---|---|---|---|---|---|---|
| 23 (comp) | S1 | none | 24 | 75 | 1 | 0 | 1.4 | 9.9 | 1.3 |
| 24 | S1 | none | 45.3 | 51.3 | 3.4 | 0 | 1 | 11.2 | 11 |
| 25 (comp) | S1 | none | 45.3 | 51.3 | 3.4 | 0 | 2 | — | — |
| 26 | S1 | none | 28 | 67 | 5 | 0 | 0.85 | 2.6 | 7.7 |
| 27 (comp) | S1 | none | 28 | 67 | 5 | 0 | 1.85 | 12 | 2.3 |

What is claimed is:

1. Fluorinated greases comprising at least:

15%–50% by weight of a polytetrafluoroethylene or tetrafluoroethylene copolymers with other ethylenically unsaturated monomers totally or partially fluorinated;

30%–84.5% by weight of perfluoropolyether oil having a viscosity comprised between 20 and 4000 cSt at 20° C.;

0.5%–10% by weight of surfactant or dispersant having perfluoropolyether or perfluoroalkylic chain;

0%–10% by weight of an anticorrosion and/or antiwear additive, said fluorinated greases being obtained by a process comprising at least the following steps:

a) obtaining a TFE-based (perfluoropolymer by polymerization in an aqueous phase;

b) adding surfactants in an amount from 50 to 500 mg per gram of polymer to the TFE-based (per)fluoropolymer in the aqueous phase;

c) adding to the aqueous phase of b) a perfluoropolyether oil having a viscosity lower than 5 cSt at 25° C. and a boiling point not greater than 150° C., or to a fluorocarbon with a boiling point lower than 150° C., so that the ratio by weight of polymer/oil is lower than 0.5;

d) adding a perfluoropolyether oil having a viscosity between 20 and 4000 cSt at 20° C. in amounts such as to obtain in the final grease a polymer percentage by weight of between 15% and 50%;

e) evaporating completely under vacuum the low boiling components at a temperature between 50° C. and 90° C.

such that the (per)fluoropolymer particles based on TFE or their aggregates have average sizes smaller than a micron.

2. Fluorinated greases according to claim 1, characterized in that they contain 15–30% by weight of polytetrafluoroethylene or its copolymers.

3. Fluorinated greases according to claim 1 comprising a thermoplastic copolymer of tetrafluoroethylene/perfluoromethylvinylether/fluorinated monomers having the composition:

perfluoromethylvinylether: 2–9%;

fluorinated monomers selected from perfluoropropylvinylether and perfluorodioxols between 0 and 1.5%; and tetrafluoroethylene to 100%.

4. Fluorinated greases according to claim 1, wherein a TFE homopolymer or a TFE copolymer is used, selected from:

modified polytetrafluoroethylene containing between 0.01 and 8% by moles of one or more comonomers selected from perfluoroalkylperfluorovinylethers, vinylidene fluoride, perfluoropene, and chlorotrifluoroethylene; and tetrafluoroethylene thermoplastic copolymers containing from 0.5 to 13% by weight of perfluoromethylvinylether and from 0.05 to 5% by weight of one or more fluorinated monomers selected from perfluoropropylvinylethers and/or perfluorodioxols having the formula

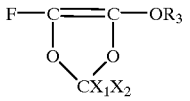

wherein $R_3$ is a $C_1$–$C_5$ perfluoroalkylic radical;

$X_1$ and $X_2$are, independently from each other, a fluorine atom or a perfluoroalkyl with one to three carbon atoms.

5. Fluorinated greases according to anyone of claims 1, 2, 3 and 4, wherein the perfluoropolyether oil comprises fluorooxyalkylenic units selected from:

$$(CF_2CF_2O),\ (CF_2O),\ (CF_2CF(CF_3)O),\ (CF(CF_3)O),\ (CF_2CF_2CF_2O),\ (CF_2CF(OX_3)O)\ \text{and}\ (CF(OX_3)O),$$

wherein $X_3$ is $—(CF_2)_nCF_3$ and n=0,1,2,3,4, said units being statistically distributed in the polymeric chain, the end groups being selected from:

$$—CF_3,\ —C_2F_5,\ —C_3F_7,\ ClCF_2CF(CF_3)—,\ CF_3CFClCF_2—,\ ClCF_2CF_2—,\ ClCF_2—,\ —CF_2H,\ —CF(CF_3)H.$$

6. Fluorinated greases according to claim 5 wherein the end groups of the perfluoropolyether oil in step d) are perfluoroalkylic.

7. Fluorinated greases acording to claim 5 wherein the perfluoropolyethers are selected from the following classes:

$$\text{(a1)}\ T_1—O(CF(CF_3)—CF_2O)_a(CFXO)_b—T_2$$

wherein:

$T_1$ and $T_2$, equal to or different from each other, are $—CF_3$, $—C_2F_5$, or $-C_3F_7$ groups, X is —F or $—CF_3$;

a, b are integers such that the molecular weight gives said viscosity;

$$\text{(b}_1\text{)}\ CF_3—O(CF_2CF_2O)_c(CF_2O)_d—CF_3$$

wherein:

c, d are integers such that the molecular weight gives said viscosity;

$(c_1)$ $C_3F_7—O(CF(CF_3)—CF_2O)_e—T_3$ wherein:

$T_3$ is $—C_2F_5$, or $—C_3F_7$;

e is an integer such that the molecular weight gives said viscosity $(d_1)$ $T_4—O(CF(CF_3)—CF_2O)_g(C_2F_4O)_h(CFXO)_i—T_5$ wherein:

$T_4$ and $T_5$, equal to or different from each other, are perfluorinated groups $—CF_3$, $—C_2F_5$, or $—C_3F_7$;

X is —F or $—CF_3$;

g, h, i, are integers such that the molecular weight gives said viscosity $(e_1)$ $T_6—O(CF_2CF_2CF_2O)_l—T_7$ wherein:

$T_6$ and $T_7$, equal to or different from each other are $—CF_3$, $—C_2F_5$, or $—C_3F_7$ groups;

l is an integer such that the molecular weight gives said viscosity;

$(f_1)$ $T_8—O(CF_2CF_2O)_m—T_9$ wherein:

$T_8$ and $T_9$, equal to or different from each other, are $—CF_3$, or $—C_2F_5$ groups;

m is an integer such that the molecular weight gives said viscosity.

8. Fluorinated greases according to claim 7 wherein the (per)fluoropolyethers are those of class $(a_1)$ having viscosity from 1000 to 3000 cSt.

9. Fluorinated greases according to claim 1, wherein the fluorinated surfactants having a perfluoropolyether or perfluoroalkylic chain are of ionic or non ionic type, wherein the functional part of the fluorinated chain is selected from:

mono and dicarboxylic acids and their salts;

sulphonic acids and their salts;

phosphoric esters and their salts having 1 or 2 hydrophobic chains;

non ionic surfactants having fluorinated chains and polyoxyalkylenic chains;

cation surfactants having 1, 2 or 3 hydrophobic chains.

10. Fluorinated greases according to claim 9 wherein the surfactant is a carboxylic surfactant with a perfluoropolyether chain having an average molecular weight lower than 600.

11. The grease according to claim 1 wherein the surfactant is added in amounts of 100 to 300 mg.

12. A process for preparing fluorinated greases comprising at least the following steps:

a) obtaining a TFE-based (per)fluoropolymer by polymerization in an aqueous phase;

b) adding surfactants in an amount from 50 to 500 mg per gram of polymer to the TFE-based (per)fluoropolymer in the aqueous phase;

c) adding to the aqueous phase of b) a perfluoropolyether oil having a viscosity lower than 5 cSt at 25° C. and a boiling point not greater than 150° C., or to a fluorocarbon with a boiling point lower than 150° C., so that the ratio by weight of polymer/oil is lower than 0.5;

d) adding a perfluoropolyether oil having a viscosity between 20 and 4000 cSt at 20° C. in amounts such as to obtain in the final grease a polymer percentage by weight of between 15% and 50%;

e) evaporating completely under vacuum the low boiling components at a temperature between 50° C. and 90° C.

13. Process for preparing the fluorinated greases according to claim 12 characterized in that it comprises an antiwear and/or antirust additive added in any step of the process.

14. Process for preparing fluorinated greases according to claim 13 wherein the surfactants or the dispersants used in step b are antiwear and/or antirust additives.

15. Process for preparing fluorinated greases according to claim 12, wherein the (per)flouropolymers in the aqueous phase are latexes obtained by polymerization processes which use water as reaction medium.

16. Process for preparing fluorinated greases according to claim 12, 13, 14 or 15 wherein the aqueous phase of (per)fluoropolymer at step b) is obtained by a gelling process, neutralization, dispersion of gel, of aqueous latexes of step a) and comprising at least the following steps:

a") gel formation by addition of electrolytes, b") gel neutralization with alkaline solutions and successive washing with water, c") gel redispersion with the surfactants.

17. The method according to claim 12 wherein the surfactant is added in amounts of 100 to 300 mg.

* * * * *